United States Patent [19]

Schnell

[11] Patent Number: 4,552,462

[45] Date of Patent: Nov. 12, 1985

[54] STIRRER APPARATUS FOR PAPER STOCK

[75] Inventor: Hans Schnell, Mengen, Fed. Rep. of Germany

[73] Assignee: Escher Wyss GmbH, Ravensburg, Fed. Rep. of Germany

[21] Appl. No.: 544,786

[22] Filed: Oct. 24, 1983

[30] Foreign Application Priority Data

Nov. 1, 1982 [CH] Switzerland ..... 6338/82
Feb. 7, 1983 [CH] Switzerland ..... 666/83

[51] Int. Cl.[4] ..... B01F 7/30

[52] U.S. Cl. ..... 366/280; 366/283; 366/287; 366/306

[58] Field of Search ..... 366/241, 261, 279, 280, 366/281, 282, 287, 288, 306, 307, 330, 331

[56] References Cited

U.S. PATENT DOCUMENTS

| | | | |
|---|---|---|---|
| 2,345,163 | 3/1944 | Vollrath | 366/261 |
| 3,272,480 | 9/1966 | Sukup | 366/261 |
| 4,217,996 | 8/1980 | Good | 366/287 |
| 4,374,621 | 2/1983 | Stille | 366/261 |
| 4,382,685 | 5/1983 | Pearson | 366/306 |

FOREIGN PATENT DOCUMENTS

| | | | |
|---|---|---|---|
| 560897 | 7/1958 | Canada | 366/287 |
| 2124313 | 11/1972 | Fed. Rep. of Germany | 366/287 |
| 565704 | 7/1977 | U.S.S.R. | 366/287 |
| 644539 | 1/1979 | U.S.S.R. | 366/287 |

*Primary Examiner*—Robert W. Jenkins
*Assistant Examiner*—Arthur D. Dahlberg
*Attorney, Agent, or Firm*—Werner W. Kleeman

[57] ABSTRACT

A vane shaft is suspended within a container in a pendulum or swinging fashion at its drive shaft by means of a pivotable coupling. The drive shaft can constitute the output shaft of a drive arrangement composed of a drive motor equipped with a transmission or gearing unit and supported upon a radial arm member. The drive motor together with its transmission also can be arranged in or at a central axis of the orbiting or revolving path of movement of the vane shaft, and the drive shaft can connect the drive motor equipped with the transmission with the vane shaft in the manner of a Cardan shaft. The vane shaft also can be directly suspended at the vertical output shaft of the transmission or gearing arrangement by means of a pivotable coupling. At the lower end of the vane shaft there is secured a buoyant or float body member serving for the lateral deflection of the vane shaft. Above the level of the liquid confined within the container the latter is provided with a substantially ring-shaped guide arrangement which limits the deflection of the vane shaft towards the outside.

20 Claims, 9 Drawing Figures

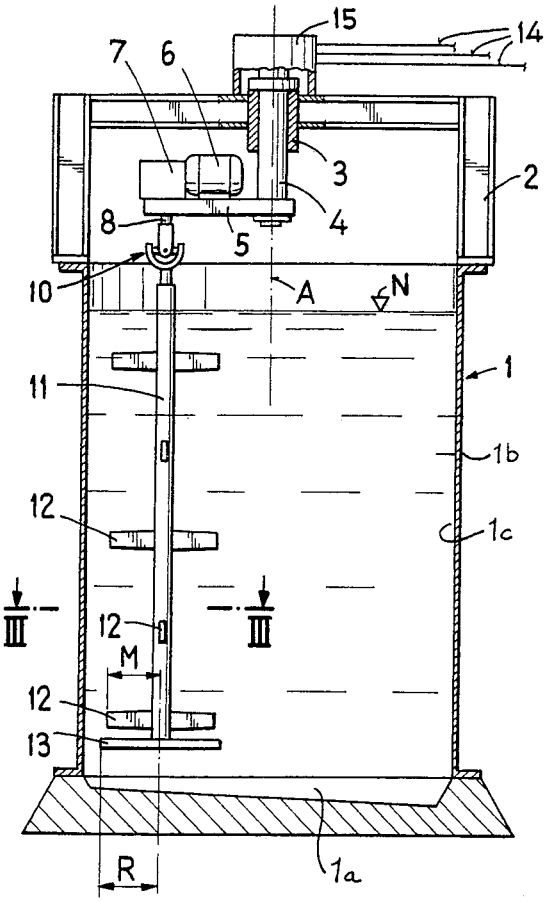
Fig.1
Fig.3
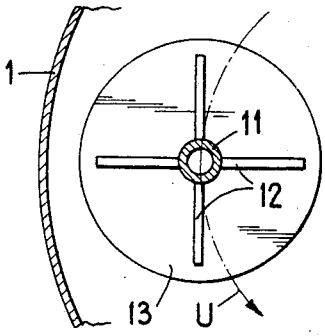
Fig.2
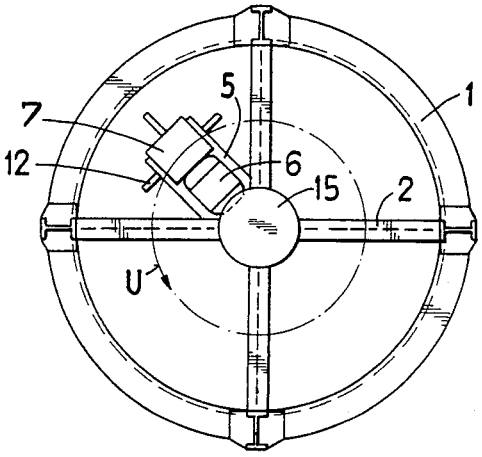
Fig.4
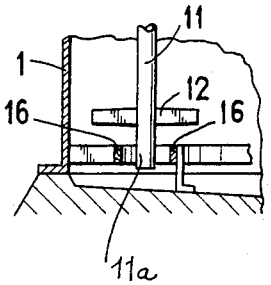

STIRRER APPARATUS FOR PAPER STOCK

BACKGROUND OF THE INVENTION

The preent invention relates to a new and improved construction of a stirrer apparatus for paper stock or the like.

In its more specific aspects the present invention relates to an improved stirrer apparatus for paper stock or the like, wherein there is provided at least one vane shaft located within a stock container or the like, the vane shaft being provided with protruding turbulence or agitation elements. The vane shaft is operatively connected by means of a drive shaft with a motor drive arrangement and during operation revolves or orbits in a substantially circular-shaped path of travel about a central axis.

Such type of stirrer apparatus is known to the art from German Pat. No. 1,913,819. With this state-of-the-art equipment the vane shaft travels about a central shaft which is arranged substantially in parallelism therewith. This central shaft is supported at the floor or base of the container within a footstep or base bearing structure and possesses lateral arms or arm members equipped with bearings for the vane shaft. The footstep or base bearing arrangement of the central shaft and the lower bearing of the vane shaft are located within the stock suspension.

This known stirrer apparatus is relatively complicated. Additionally the bearings located in the stock suspension are loaded in an unfavorable fashion.

SUMMARY OF THE INVENTION

Therefore, with the foregoing in mind it is a primary object of the present invention to provide an improved construction of a stirrer apparatus for paper stock or the like which is not afflicted with the aforementioned drawbacks and limitations of the prior art.

Another and more specific object of the present invention is directed to a new and improved construction of a stirrer apparatus which, on the one hand, possesses a much simpler construction and can be mounted much more easily than the heretofore known stirrer apparatuses, does not possess any bearing arrangement located within the stock suspension, and furthermore, affords additional advantages in terms of, for instance, enabling the realization of a better admixing of the liquid of the stock suspension.

Yet a further important object of the present invention is concerned with a new and improved stirrer apparatus for paper stock or the like, which is relatively simple in construction and design, extremely reliable in operation, not readily subject to breakdown or malfunction, requires a minimum of maintenance and servicing, and affords a better mixing and processing of the paper stock or the like.

Now in order to implement these and still further objects of the invention, which will become more readily apparent as the description proceeds, the stirrer apparatus of the present development is manifested by the features that the vane shaft is suspended in a pendulum or swinging fashion at its drive shaft by means of a pivotable coupling, while avoiding the use of any bearing or mounting arrangement or the like at the lower end of the vane shaft.

The pendulum or swinging suspension of the vane shaft at the drive shaft makes it possible to dispense with the use of any footstep or base bearing arrangement. An inclination of the vane shaft in relation to the vertical, arising during operation of the stirrer apparatus, is advantageous inasmuch as there is augmented mixing of the paper stock in vertical direction.

According to one possible construction of the invention a freely rotatable central shaft can be arranged at the central axis. This freely rotatable central shaft is provided with at least one radial arm member at which there is arranged the vertical drive shaft. The mounting of or bearing arrangement for the central shaft is exclusively located above the level of the stock within the container with which the stirrer apparatus is operatively associated.

A drive motor having a transmission or gearing arrangement can be secured at the radial arm member. The output shaft of the transmission can form the vertical drive shaft. In this way there is obtained a simple and robust design, and there is avoided any mounting or bearing arrangement within the stock suspension.

According to a further embodiment of the invention the vane shaft can be operatively connected with a drive shaft which, in turn, is connected with a drive motor equipped with a transmission or gearing arrangement and arranged essentially in the central axis of the circular-shaped or orbiting path of travel. The output shaft of the drive arrangement composed of the drive motor and the transmission is arranged at the central axis. Moreover, the drive shaft can be supported upon a support ring member which is concentric to the central axis of the circular-shaped revolving or orbiting path of travel. In this way there is obtained an extremely simple construction which, for instance, is especially well suited for use with smaller stirrer apparatuses.

On the other hand, there is also possible a design wherein the drive shaft together with the drive motor is movable along at least one substantially circular-shaped guide device at the circumference of the container. In this case there is obtained an extremely simple construction of the equipment which does not require the container to be provided with any superstructure.

In all of the aforementioned embodiments the pivotable coupling can be constituted by a Cardan or universal joint. This, in turn, leads to an extremely simple and operationally reliable design of the stirrer apparatus.

Furthermore, the vane or stirrer shaft can be provided at its lower end with a weight or the like. By means of this weight there can be influenced or controlled the inclination of the shaft in relation to the vertical during operation of the stirrer apparatus.

The weight can possess the form of a circular part or element, the radius of which is greater than the radius of the turbulence or agitation elements of the vane shaft. Due to these measures there can be effectively precluded any impacting or striking of the stirrer vanes or blades of the vane shaft against the inner wall of the container.

However, for the same purpose the lower end of the vane shaft also may coact with a substantially ring-shaped or annular guide arrangement or guide member.

However, the vane shaft also can be directly connected with a drive shaft located essentially in the central axis of the circular-shaped or orbiting path of travel and can be constituted by the output shaft of the drive arrangement likewise arranged substantially at the central axis. Also, means can be provided for the lateral deflection of the vane shaft out of a substantially vertically position.

Due to these measures there is beneficially obtained a particularly simple stirrer apparatus which contains very few parts. Furthermore, due to the inclined position which the vane shaft may assume by virtue of its lateral deflection there is realized in even more efficacious admixing or agitation of the contents of the container, and specifically due to the presence of a force component which is directed towards the center of the container.

Preferably, the vane shaft can be equipped at its lower end with a buoyant or float body member which is suitable for the lateral deflection or shifting of the vane shaft close to the marginal region or inner wall of the container. In this manner there can be realized the deflection or shifting of the vane shaft through the provision of very simple means without the need for any fixtures being incorporated beneath the miniscus or liquid level of the liquid contained within the container or receptacle.

Furthermore, the buoyant or float body member can be designed as a hollow body of revolution which at least approximately possesses a shape suitable for the deflection of the flow of the paper stock towards or away, as the case may be, from the lengthwise axis if the vane shaft. As a result there is simultaneously obtained an advantageous guiding of the flow of the stock suspension by the buoyant or float body member.

The vane shaft can be advantageously equipped with a substantially ring-shaped or annular guide member arranged above the liquid level of the container. This ring-shaped guide member limits the deflection or shifting of the vane shaft towards the outside. In this way there can be beneficially realized a guiding of the vane shaft along a substantially circular-shaped path of travel without the need for the aforementioned fixtures being installed within the stock suspension chamber of the container, and there is prevented impact of the vane shaft against the inner wall of the container.

According to a further embodiment of the invention the vane shaft can be provided at its upper region located above the liquid level of the container with a freely rotatable roll or roller member. This roller member rolls upon the ring-shaped guide member which is likewise arranged above the liquid level.

The vane shaft can be preferably provided with turbulence or agitation elements possessing the form of vanes or blades arranged at a desirable angle of attack with regard to the lengthwise axis of the vane shaft. These vanes or blades cause an advantageous vertical flow of the stock suspension within the container along the vane shaft, and specifically, depending upon the direction of rotation of such vane shaft, either from the bottom towards the top or from the top towards the bottom.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components or elements, and wherein:

FIG. 1 is a vertical sectional view of a stock container or receptacle in the form of a vat for receiving the paper stock which is to be processed and equipped with a first exemplary embodiment of stirrer apparatus according to the invention;

FIG. 2 is a top plan view of the arrangement of FIG. 1;

FIG. 3 is a cross-sectional view of the arrangement of FIG. 1, taken substantially along the line III—III thereof;

FIG. 4 is a fragmentary detail sectional view of the arrangement of FIG. 1 equipped with a somewhat different construction of stirrer apparatus;

DETAILED DESCRIPTION OF THE PREFERRED EMBODIMENTS

Figure 5:
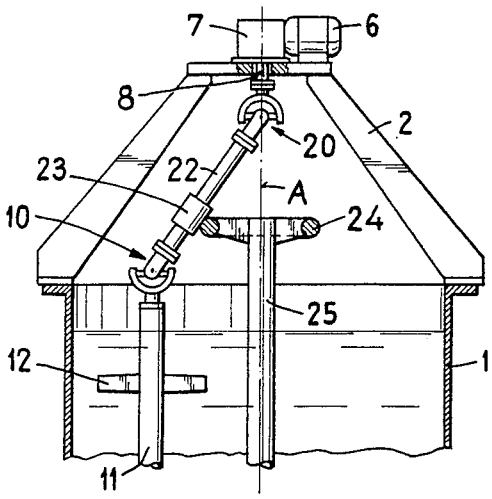
FIGS. 5 and 6 respectively show fragmentary sectional views of the upper end or region of the container, similar to the arrangement of FIG. 1, but depicting two further embodiments of stirrer apparatus according to the invention.

Describing now the drawings, it is to be understood that in order to simplify the illustration only enough of the details of the stirrer apparatus and related container or receptacle structure have been shown therein as needed for those skilled in the art to readily understand the underlying principles and concepts of the present development. Turning attention now to the exemplary embodiment of stirrer apparatus as depicted in FIGS. 1 to 3, and as specifically shown in FIG. 1 there is provided a container or receptacle 1 defining a vat for reception of the paper stock or the like which is to be processed. This stock container or receptacle 1 is provided with a substantially cross-shaped support structure 2, as particularly evident by referring to FIG. 2. At such cross-shaped support structure 2 there is mounted a bearing or support 3 for a freely rotatable and centrally arranged shaft or shaft member 4. Secured to the shaft member 4 is a radial arm member 5. Arranged upon this radial arm member 5 is a drive motor 6 equipped with a transmission or gearing 7, the drive motor 6 and transmission 7 forming a drive arrangement. The output shaft 8 of the transmission or gearing 7 is arranged to extend substantially vertically and downwardly towards the floor or base 1*a* of the container 1. A vane or blade shaft 11 is suspended for swinging or pendulum-like movement by means of a Cardan or universal joint 10 or equivalent structure at the output shaft 8. This vane shaft 11 is advantageously equipped with protruding turbulence or agitation elements 12, for instance in the form of stirrer vanes or blades.

At its lower end the vane shaft 11 is provided with a weight 13 having the shape of a substantially circular or round body member, the radius R of which is somewhat greater than the radius M of the turbulence or agitation elements 12.

The current infeed to the drive motor 6 is accomplished by means of supply lines 14 with the aid of a collecting or slip ring head member 15 or equivalent structure.

Now with the embodiment of stirrer apparatus depicted in FIGS. 1 to 3, when the electric drive motor 6 places the vane shaft 11 into rotational movement by means of the transmission or gearing arrangement 7, there results apart from the agitation or turbulence of the stock suspension located within the confines of the container or receptacle 1 and which is at the stock level N within its stock or suspension chamber 1*b*, a revolving or orbiting movement of the vane shaft 11 in the direction of the arrow U of FIG. 2 about a central axis A.

As will be particularly evident by inspecting FIG. 1, all of the bearings or support structure of the stirrer apparatus as well as the pivotable coupling or coupling member constituted by the Cardan or universal joint 10 are located above the level N of the stock suspension contained in the container or receptacle 1.

As already mentioned the weight 13 assists in influencing the vertical position of the vane shaft 11. The ratio of the radii R and M of the weight 13 and the turbulence or agitation elements 12, respectively, prevents impacting of the vane or blade shaft 11 equipped with the agitation or turbulence elements 12 against the inner wall 1*c* of the container or receptacle 1.

In lieu of the weight 13 or also in conjunction with such weight 13 there can be arranged at the region of the lower end of the vane shaft 11 a guide member or arrangement, as the same has been depicted in FIG. 4. According to the variant construction of stirrer apparatus shown in such FIG. 4 this guide arrangement comprises two substantially ring-shaped or annular rails or rail members 16 which coact with a protruding lower end 11*a* of the vane shaft 11. Under certain circumstances it is sufficient to only provide one of the rail members 16.

With the embodiment depicted in FIG. 5 the drive arrangement composed of the drive motor 6 equipped with the transmission or gearing 7 is arranged upon the support structure 2 in such a fashion that the output shaft 8 of the transmission or gearing 7 is located essentially at the axis A of the revolving or orbiting movement of the vane shaft 11. A drive shaft 22 is connected by means of a Cardan or universal joint 20 with the output shaft 8. This drive shaft 22 is coupled at its lower end by means of the Cardan or universal joint 10 with the vane shaft 11. The drive shaft 22 is provided with a substantially cylindrical roll or roller member 23 which rolls upon a substantially circular-shaped guide member 24 which is supported at the upper region of a central support or column member 25. This support member 25 is secured in any suitable fashion to the floor or base 1*a* of the container or receptacle 1.

Also in this case during operation of the stirrer apparatus the vane shaft 11 performs a revolving or orbiting movement within the container or receptacle 1, and during such time the roller member 23 rolls upon the guide member 24. In all other respects the function of the stirrer apparatus depicted in FIG. 5 as well as its remaining structure is like the embodiments of stirrer apparatuses heretofore considered with regard to FIGS. 1 to 4.

Figure 7:
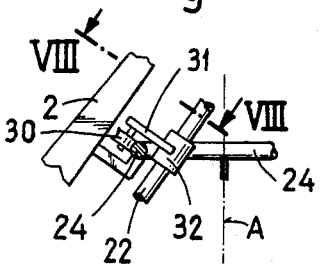
FIG. 7 is a fragmentary sectional view of the arrangement of FIG. 5 portraying a further possible construction of such stirrer apparatus.
Figure 8:
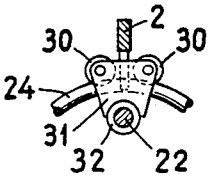
FIG. 8 is a cross-sectional view of the arrangement of FIG. 7, taken substantially along the line VIII—VIII thereof.

In FIGS. 7 and 8, depicting a fragmentary sectional view of the arrangement of FIG. 5, there are shown further possible constructions of stirrer apparatus. Specifically, in FIG. 7 there is shown an arrangement wherein a substantially circular-shaped or annular support or guide ring member 24 is secured to the support structure 2. Two rolls or roller members 30 of a guide element 31 roll upon the circular-shaped or annular support or guide ring member 24. The guide element 31 possesses a bushing or sleeve 32 within which there is rotatably guided the drive shaft 22.

This embodiment of the invention, while possessing the same mode of operation as the embodiment of FIG. 5, has the advantage in relation thereto that in this case there can be dispensed with the use of an inner support or column member 25.

Figure 6:
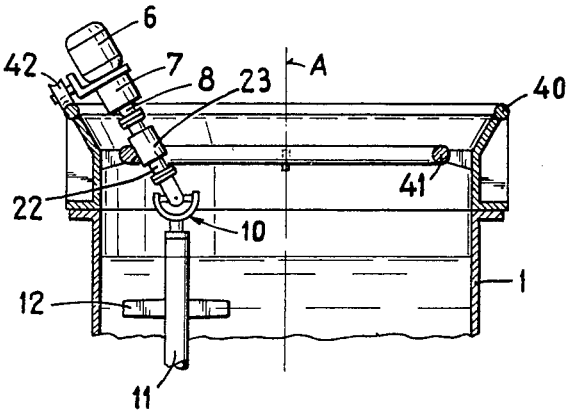

With the embodiment of FIG. 6 there is additionally present the advantage that the entire support structure can be dispensed with, resulting in improved accessibility to the interior of the container or receptacle 1. In this case there are provided two guide members 40 and 41 which are concentrically arranged with respect to the lengthwise or central axis A of the container 1. The drive motor 6 and its transmission or gearing 7 are equipped with rollers or roller members 42 which are guided upon the upper guide member 40. Operatively connected or merging with the output shaft 8 of the drive motor 6 is a drive shaft 22 which, in turn, is provided with a rotatable roller or roll member 23 which rolls upon the inner surface of the lower guide member 41. The end of the drive shaft 22 is connected by means of a Cardan or universal joint 10 or equivalent structure with the vane or blade shaft 11.

Figure 9:
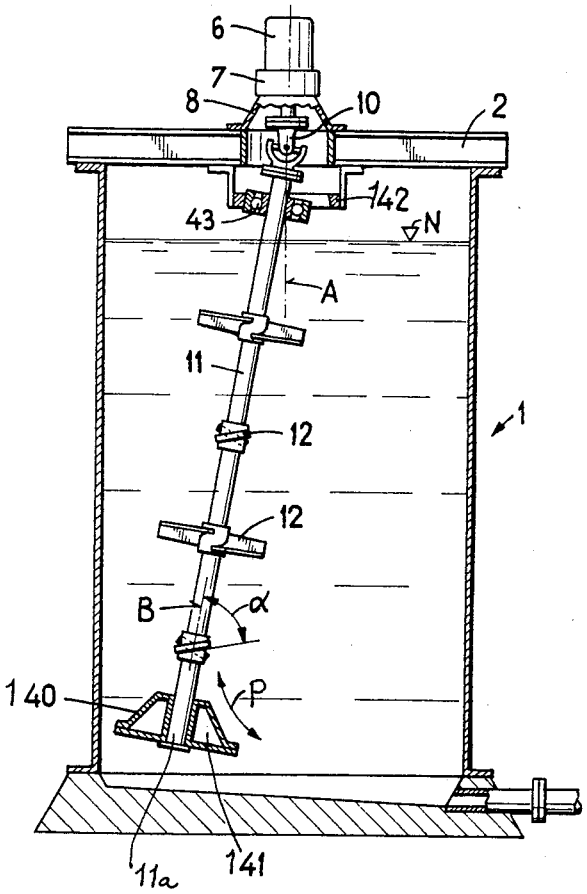
FIG. 9 illustrates a further embodiment of inventive stirrer apparatus.

With the embodiment of stirrer apparatus depicted in FIG. 9 there is arranged at the container or receptacle 1, for instance constituting a vat of a papermaking machine, the drive motor 6 equipped with the transmission or gearing 7 and which is arranged upon the support structure 2. At the output shaft 8 of the transmission or gearing 7 there is suspended the vane or blade shaft 11 by means of the Cardan or universal joint 10 or equivalent structure. This vane shaft 11 is likewise provided with protruding turbulence or agitation elements 12. These turbulence or agitation elements 12 advantageously possess the form of vanes or blades which are arranged at a suitable angle of attack $\alpha$ with respect to the lengthwise axis of the vane shaft 11, this angle of attack $\alpha$ here defining an acute angle.

At the lower end 11*a* of the vane shaft 11 there is arranged a buoyant or float body member 140 having a hollow chamber or space 141. The buoyant or float body member 140 is constituted by a body of revolution having a shape suitable for deflection of the flow of the paper stock towards or from the lengthwise axis B of the vane shaft 11. This stock flow has been conveniently represented in the drawing by a curved double-headed arrow P located alongside the buoyant or float body member 140. Above the liquid level N there is secured at the container or receptacle 1, and specifically at the support structure or support arrangement 2 a substantially ring-shaped or annular guide member 142 upon which rolls a roller member 43. This roller member 43 is appropriately attached to the vane shaft 11. As illustrated in FIG. 9, the roller member 43 can be formed by a simple ball bearing.

During operation of the stirrer apparatus depicted in FIG. 9, the vane shaft 11, depending upon its direction of rotation, circulates and moves the stock suspension along its lengthwise axis B either upwardly or downwardly, and in this manner such stock suspension is intensively agitated or admixed and placed into a state of turbulence. Moreover, the vane shaft 11 carries out a revolving or orbiting movement about the lengthwise axis A of the output shaft 8 which also may coincide with the lengthwise or central axis of the container 1. The laternal deflection of the vane shaft 11 out of the vertical position, which has been depicted in FIG. 9, is accomplished under the influence of the buoyant or float body member 140, the lifting or buoyancy force of which is appropriately dimensioned by selecting the size of the hollow space or chamber 141. This lateral deflection or shifting of the vane shaft 11 is limited by the ring-shaped guide member 142 acting as a stop and upon which rolls the roller member 43.

It should be understood that within the teachings and concepts of the present invention different modifications are possible from the exemplary embodiments disclosed herein by way of example and not limitation. Thus, for instance, with the embodiment of FIGS. 1 and 2 there may be provided a plurality of radial arm members 5 which are arranged at different angular positions with respect to one another. For instance, there could be provided two arm members 5 which are offset or spaced from one another through an angle of about 180°. The pivotable coupling or coupling member 10 need not be constituted by a Cardan or universal joint; quite to the contrary there could be provided a different type of joint or coupling structure or even only an elastic component. With the embodiment of FIG. 6 it is possible, under circumstances, to provide only a single guide member which replaces the guide members 40 and 41 and is appropriately constructed. The weight 13 at the lower end of the vane shaft or shaft member 11 can be dispensed with, particularly if there is used a substantially ring-shaped guide member 16 as shown for instance in FIG. 4.

While there are shown and described present preferred embodiments of the invention, it is to be distinctly understood that the invention is not limited thereto, but may be otherwise variously embodied and practiced within the scope of the following claims.

Accordingly, what I claim is:

1. A stirrer apparatus for paper stock, comprising:
a container for receiving paper stock therein;
at least one vane shaft arranged within said container;
said vane shaft being provided with protruding agitation elements;
drive means including a drive shaft for driving said vane shaft so as to travel along a substantially circular-shaped path of travel about a central axis;
pivotable coupling means for suspending said vane shaft at said drive shaft so as to carry out random pendulum-like movements essentially over the entire cross-section of said container; and
said vane shaft having a lower end devoid of any mounting arrangement therefor.

2. The stirrer apparatus as defined in claim 1, further including:
a freely rotatable central shaft member arranged substantially at said central axis;
said central shaft member being provided with at least one radially extending arm member at which there is arranged said drive shaft;
said drive shaft being substantially vertically arranged; and
bearing means for mounting said freely rotatable central shaft member at a location exclusively above the level of the paper stock located in said container.

3. The stirrer apparatus as defined in claim 2, wherein:
said drive means comprises a drive motor equipped with a transmission and secured to said radial arm member; and
said transmission having an output shaft defining said vertically arranged drive shaft.

4. The stirrer apparatus as defined in claim 1, further including:
a drive shaft member with which there is connected said vane shaft;
said drive means comprising a drive motor provided with a transmission substantially arranged at the central axis of the circular-shaped path of travel;
said drive shaft member being connected with said drive motor equipped with said transmission; and
said transmission having an output shaft defining said drive shaft and which is arranged substantially at said central axis.

5. The stirrer apparatus as defined in claim 4, further including:
a support ring member arranged substantially concentrically with respect to the central axis of the circular-shaped path of travel; and
said drive shaft member being supported at said support ring member.

6. The stirrer apparatus as defined in claim 1, further including:
a drive shaft member operatively connected with said drive shaft;
at least one substantially circular-shaped guide means;
said drive means comprising a drive motor; and
said drive shaft member together with said drive motor being movable along said at least one substantially circular-shaped guide means at the circumference of said container.

7. The stirrer apparatus as defined in claim 1, wherein:
said pivotable coupling means comprises a Cardan joint.

8. The stirrer apparatus as defined in claim 1, wherein:
said vane shaft has a lower end; and
a weight provided for the lower end of said vane shaft.

9. The stirrer apparatus as defined in claim 8, wherein:
said weight possesses the shape of a substantially round element having a radius which is greater than the radius of the agitation elements of the vane shaft.

10. The stirrer apparatus as defined in claim 1, wherein:
said vane shaft has a lower end; and
a substantially ring-shaped guide means with which coacts the lower end of said vane shaft.

11. The stirrer apparatus as defined in claim 1, wherein:
said drive means includes a transmission having an output shaft;
said drive shaft is located at the central axis of the circular-shaped path of travel;
said vane shaft being directly connected with said drive shaft;
said drive shaft being formed by the output shaft of said transmission;
said output shaft of said transmission being located at the central axis; and
means for laterally deflecting the vane shaft out of a substantially vertical position.

12. The stirrer apparatus as defined in claim 11, wherein:

said vane shaft has a lower end;

said laterally deflecting means comprises a buoyant body member provided at the lower end of the vane shaft; and said buoyant body member serving for the lateral deflection of the vane shaft up to a marginal region of the container.

13. The stirrer apparatus as defined in claim 12, wherein:

said buoyant body member comprises a body of revolution which at least approximately possesses a shape serving for the deflection of the flow of paper stock towards and away from a lengthwise axis of the vane shaft.

14. The stirrer apparatus as defined in claim 13, further including:

a substantially ring-shaped guide means provided for said vane shaft and arranged at said container above the liquid level of the paper stock in the container; and said substantially ring-shaped guide means limiting towards the outside deflections of said vane shaft.

15. The stirrer apparatus as defined in claim 14, further including:

a freely rotatable roller member provided at an upper region of said vane shaft located above the liquid level of the paper stock in the container; and a substantially ring-shaped guide member arranged above said liquid level and upon which rolls said freely rotatable roller member.

16. The stirrer apparatus as defined in claim 12, further including:

a substantially ring-shaped guide means provided for said vane shaft and arranged at said container above the liquid level of the paper stock in the container; and said substantially ring-shaped guide means limiting towards the outside deflections of said vane shaft.

17. The stirrer apparatus as defined in claim 16, further including:

a freely rotatable roller member provided at an upper region of said vane shaft located above the liquid level of the paper stock in the container; and a substantially ring-shaped guide member arranged above said liquid level and upon which rolls said freely rotatable roller member.

18. The stirrer apparatus as defined in claim 11, further including:

agitation elements provided for said vane shaft;

said vane shaft having a lengthwise axis; and said agitation elements being defined by vane members arranged at a predetermined angle of attack with respect to the lengthwise axis of said vane shaft.

19. The stirrer apparatus as defined in claim 1, wherein:

said pivotable coupling means is structured such that said random pendulum-like movements essentially over the entire cross-section of the container prevail irrespective of the position of the vane shaft along said substantially circular-shaped path of travel of said vane shaft.

20. A stirrer apparatus for paper stock, comprising:

a container for receiving paper stock therein;

at least one vane shaft arranged within said container;

drive means including a drive shaft for driving said vane shaft so a to orbit along a substantially circular-shaped path of travel about a predetermined axis; and means for suspending said vane shaft at said drive shaft so as to carry out random pendulum-like movements essentially over the entire cross-section of said container.

* * * * *